United States Patent [19]

Taylor

[11] Patent Number: 4,921,255

[45] Date of Patent: May 1, 1990

[54] GOLF BALL

[76] Inventor: William W. Taylor, 5300 Hamilton Ave., Suite 103, Cincinnati, Ohio 45224

[21] Appl. No.: 300,048

[22] Filed: Jan. 23, 1989

Related U.S. Application Data

[63] Continuation-in-part of Ser. No. 232,186, Aug. 15, 1988, abandoned, which is a continuation-in-part of Ser. No. 204,045, Jun. 7, 1988, abandoned, which is a continuation-in-part of Ser. No. 93,281, Sep. 4, 1987, abandoned.

[51] Int. Cl.[5] ..... A63B 37/14

[52] U.S. Cl. ..... 273/232; 40/327; 40/213

[58] Field of Search ..... 273/232, 62, 235 R, 273/233, 213; 40/327; D21/205, 204

[56] References Cited

U.S. PATENT DOCUMENTS

| | | | |
|---|---|---|---|
| 1,418,220 | 5/1922 | White | 273/232 |
| 4,090,716 | 5/1978 | Martin et al. | 273/232 |
| 4,560,168 | 12/1985 | Aoyama | 273/232 |
| 4,653,758 | 3/1987 | Solheim | 273/232 |
| 4,720,111 | 1/1988 | Yamada | 273/232 |
| 4,722,529 | 2/1988 | Shaw | 273/232 |
| 4,765,626 | 8/1988 | Gobush | 273/232 |

FOREIGN PATENT DOCUMENTS

| | | | |
|---|---|---|---|
| 377354 | 7/1932 | United Kingdom | 273/232 |

*Primary Examiner*—George J. Marlo
*Attorney, Agent, or Firm*—Charles R. Wilson

[57] ABSTRACT

Golf balls have dimple patterns on their surfaces which are generated in toto from simple formulae. The dimples are arranged in rows parallel to the ball's equator. The number of dimples are based on code numbers that are multiples of four and are greater than twelve. The golf balls of the invention have markedly greater dimple symmetry than heretofore. Also one or more series of dimple patterns, as above, are disclosed whose test carry is constant for the series and in which test trajectories become flatter as the code number increases.

5 Claims, 4 Drawing Sheets

GOLF BALL

This application is a continuation-in-part of "Golf Ball Dimple Pattern", Serial No. 07/232,186, filed Aug. 15, 1988, now abandoned which is a continuation-in-part of "Symmetrically Dimpled Golf Ball", Serial No. 07/204,045, filed June 7, 1988, now abandoned, which is a continuation-in-part of "Symmetrically Dimpled Golf Ball", Serial No. 07/093,281, filed Sep. 4, 1987, now abandoned.

FIELD OF THE INVENTION

This invention relates to golf balls. More particulary, the invention relates to golf balls wherein dimples are arranged in symmetrical patterns on the surfaces of the golf balls.

BACKGROUND OF THE INVENTION

All golf balls in use today have a dimpled surface. Most of the golf balls have from about 325 to 500 dimples. The dimples are arranged in different patterns. Thus, some golf balls have dimples in rows which are arranged parallel to the ball's equator. Other golf balls have polyhedrally based dimple patterns such as an octahedron, icosahedron, or dodecahedron with either triangular or pentagonal elements.

Taylor's U.S. Pat. No. 874,254, of Feb. 4, 1908, discloses a golf ball with rows of dimples parallel to the ball's equator. However, bald caps are found at the poles. These bald caps were later found to cause asymmetrical flight depending on the attitude or lie of the ball before flight.

Pugh's British Patent No. 377,354, of July 1932, discloses the use of polyhedral bases, either octahedral, icosahedral, or dodecahedral, for his dimple patterns as a way of achieving flight symmetry. However, it took until the 1980's to discover that flight symmetry could not be achieved with polyhedrally based dimple patterns without compensating for the asymmetry of the dimple pattern by introducing an asymmetry of dimple depth between equator and pole. This produced satisfactory flight symmetry but at the expense of lost energy caused by alternating lift as the ball backspun around any axis that was not polar.

Aoyamas's U.S. Pat. No. 4,560,160 of Dec. 24, 1985, discloses golf balls wherein the mid-points on the sides of a basic equilateral triangle of icosahedral dimple patterns were joined. This succeeded in increasing the number of dimples on the ball by a factor of four. However, the result was increased dimple asymmetry as well. This required greater change of dimple depths as between equator and poles which lead to even greater loss of flight energy when the ball backspun around any axis that was not polar.

Yamada's U.S. Pat. No. 4,720,111, Jan. 19, 1988, shows octahedrally-based dimple patterns with nested triangles within a basic equilateral triangle. Such a dimple pattern achieves the best symmetry of dimple pattern of any ball prior to the present invention.

It has been taken as axiomatic in the industry that it is impossible to achieve symmetrical dimple patterns so long as dimples are arranged in rows parallel to the equator. This, in part, has resulted from the experience with the golf balls of the type disclosed in the aforementioned Taylor patent.

It is the high trajectory of a golf ball, off a driver, that separates the amateur from the professional as any golfer can attest. The duffer loves the low trajectory ball because it gives him a better chance to stay on the fairway. His erratic swing with resultant hooks or slices will be less damaging. The pro, with his precision swing, wants the high trajectory ball that approaches the target with a sharp precise drop and less roll. It has been the desire of the less skilled golfer for a low trajectory ball that has lead over recent years to the development of golf balls with more and more dimples.

OBJECTS OF THE INVENTION

An object of this invention is to establish true criteria for symmetry of dimple patterns on golf balls.

Another object of the invention is to establish dimple patterns on golf balls that follow true criteria for symmetry based on code numbers whose dimensions determine trajectory shape.

SUMMARY OF THE INVENTION

The golf balls of the invention have dimples on their surfaces arranged in a defined manner to achieve symmetry of dimple pattern. The dimples on each ball are arranged in rows parallel to the ball's equator. The number of dimples in the row nearest the ball's equator, i.e. its code number, is greater than twelve and is also a multiple of four. The number of rows in a hemisphere of the ball is the ball's code number divided by four. Further, there are always three dimples in the last row and nine dimples in the penultimate row. Golf balls with a dimple pattern meeting the criteria of this invention have coded trajectory shapes when used by amateur or professional.

DETAILED DESCRIPTION OF THE INVENTION

The golf balls of this invention have a unique dimple pattern. The dimples are arranged according to criteria set forth below. Different dimple patterns are possible, with each pattern affecting the shape of the golf ball's trajectory when hit. Additionally, several degrees of difficulty as to the trajectory of the ball when hit are controlled in a predictable manner by the manufacturer.

Figure 1:
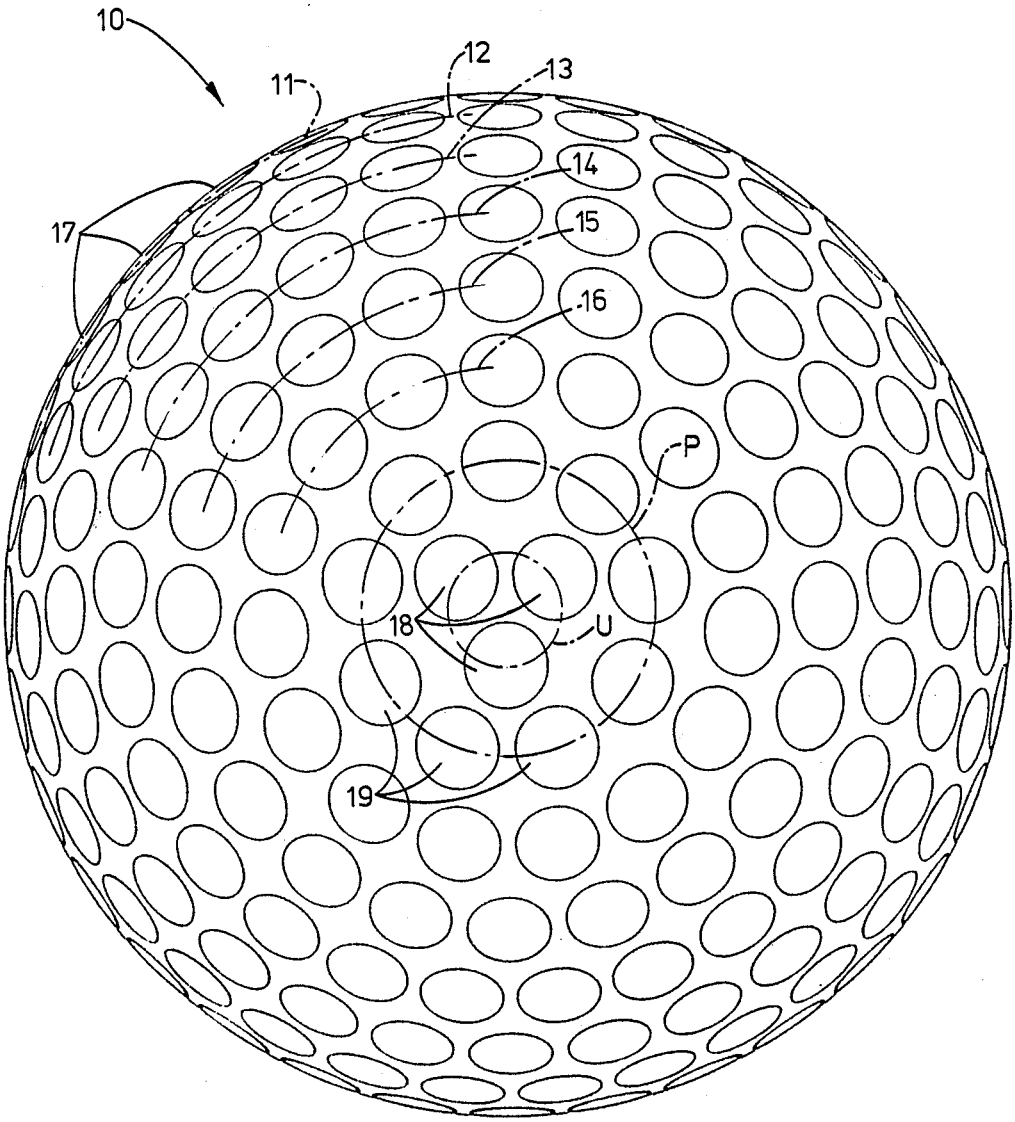
FIG. 1 is a polar view of one hemisphere of a 32 code golf ball showing a dimple pattern according to this invention.
Figure 2:
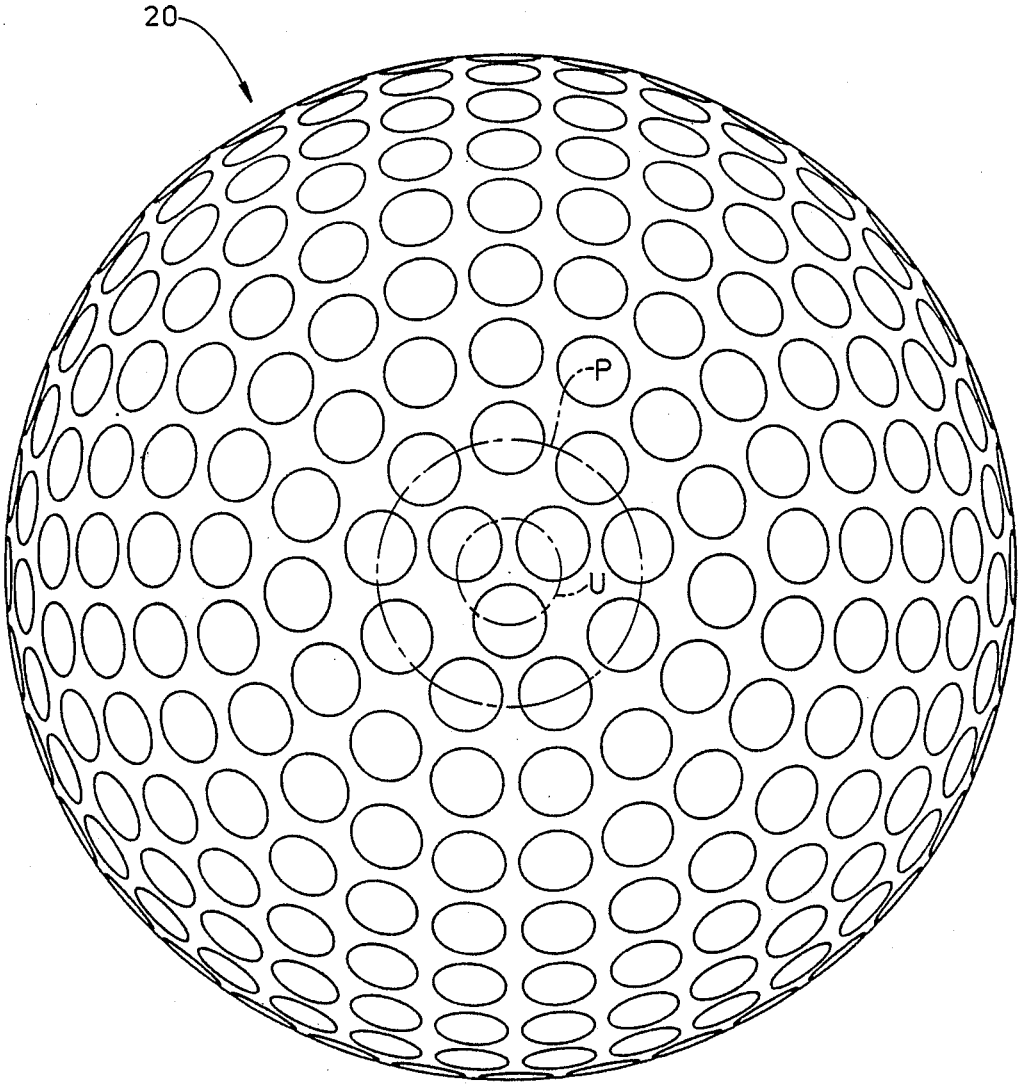
FIG. 2 is a polar view of another golf ball of this invention wherein one hemisphere has a 36 code golf ball dimple pattern.
Figure 3:
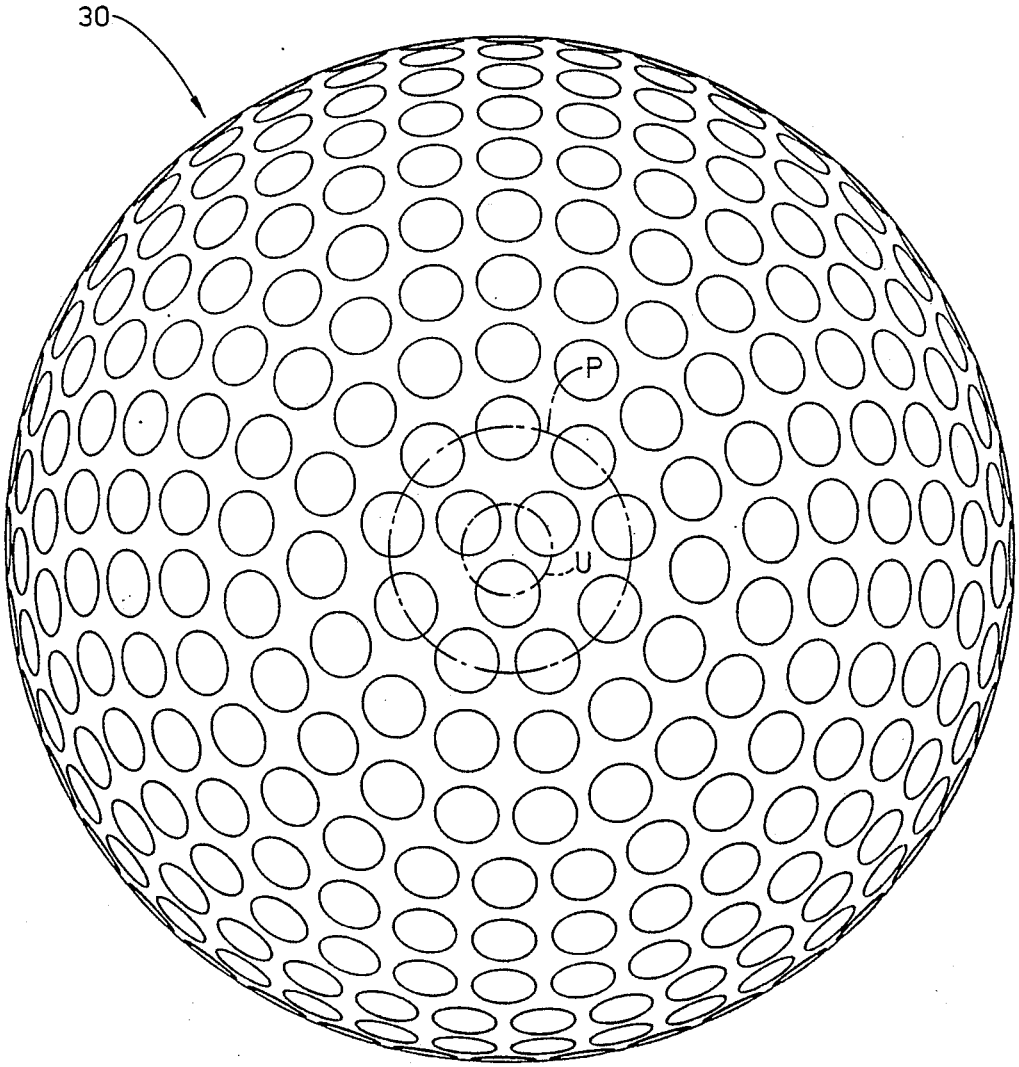
FIG. 3 is still another golf ball of the invention wherein one hemisphere of a 40 code golf ball dimple pattern is shown.

As evident, FIGS. 1–3 each illustrate one-half or hemisphere of a golf ball. The half not shown because of drawing limitations is identical. The number and arrangement of dimples on each of the three illustrated golf balls are different; however, the dimple pattern on each ball follows only one set of criteria which is explained in detail below. The golf balls are described in terms of a sphere. All spheres have two hemispheres with an equator extending around a mid-section. Additionally, all spheres have two poles diametrically opposite one another.

This invention introduces the idea of a code number to define the effect of dimple pattern on trajectory shape. The code number, n, represents the number of dimples in the first row adjacent the ball's equator; in the case of symmetrical dimple patterns only, it is related mathematically to N, the total dimples on the ball. In accord with this invention n is always a multiple of four and is always greater than twelve. Codes of from 16 to virtually any number are possible. Preferred codes range from 16 to 92. Highly preferred golf balls have codes of from 32 to 40.

With respect to the golf balls of this invention, the following common features are found:

1. There are rows of dimples in each hemisphere, with each row being parallel to the ball's equator. U is used to denote the ultimate or last row farthest from the ball's equator and P is used to denote the penultimate or next to last row.

2. The number of rows of dimples, 1 to U, in each hemisphere will always be equal to n/4.

3. The latitude of each row, 1 to P, is always equal to $[(R\times 360)-180]/n$, where R is the number of the row counting from the equator to a pole.

4. The number of dimples in rows −P, to the nearest integer, is always equal to n×the cosine of the latitude of the row, as calculated in paragraph 3 above.

5. The first dimple in each row, 1 to P, will always be located on the zero meridian.

6. There will always be nine dimples in each penultimate row, P, and three dimples in each ultimate row, U.

7. Each ultimate row, U, will always have one of its three dimples located on longitude 180 and at latitude (90−180/n cos 30).

From the foregoing, it will be understood that all dimple patterns developed according to this invention fit a set model i.e. they are generic and controlled in toto by the code number, n. The range of code numbers illustrated in FIGS. 1–3, n=32 to 40, provides a range, N, of total dimples on the ball of 326 to 508. This is substantially the same range occupied by today's commercial golf balls.

With reference to FIG. 1, golf ball 10 has a row 11 nearest the ball's equator. Row 11 and subsequent rows 12, 13, 14, 15, 16, P, and U are all parallel to the equator. Row 11 has thirty-two uniformly spaced dimples 17. As evident, row U is comprised of three dimples 18. The dimples 18 are nestled in the dimples 19 of row P. Further, row P has nine dimples 19. The ball is referred to as a 32 code ball.

In a manner similar to the golf ball 10 of FIG. 1, golf balls 20 and 30 of FIGS. 2 and 3, respectively have surfaces in a dimpled pattern. The first row adjacent ball 20's equator in FIG. 2 has thirty-six dimples to give a 36 code ball. The first row adjacent ball 30's equator has forty dimples to give a 40 code ball.

Figure 4:
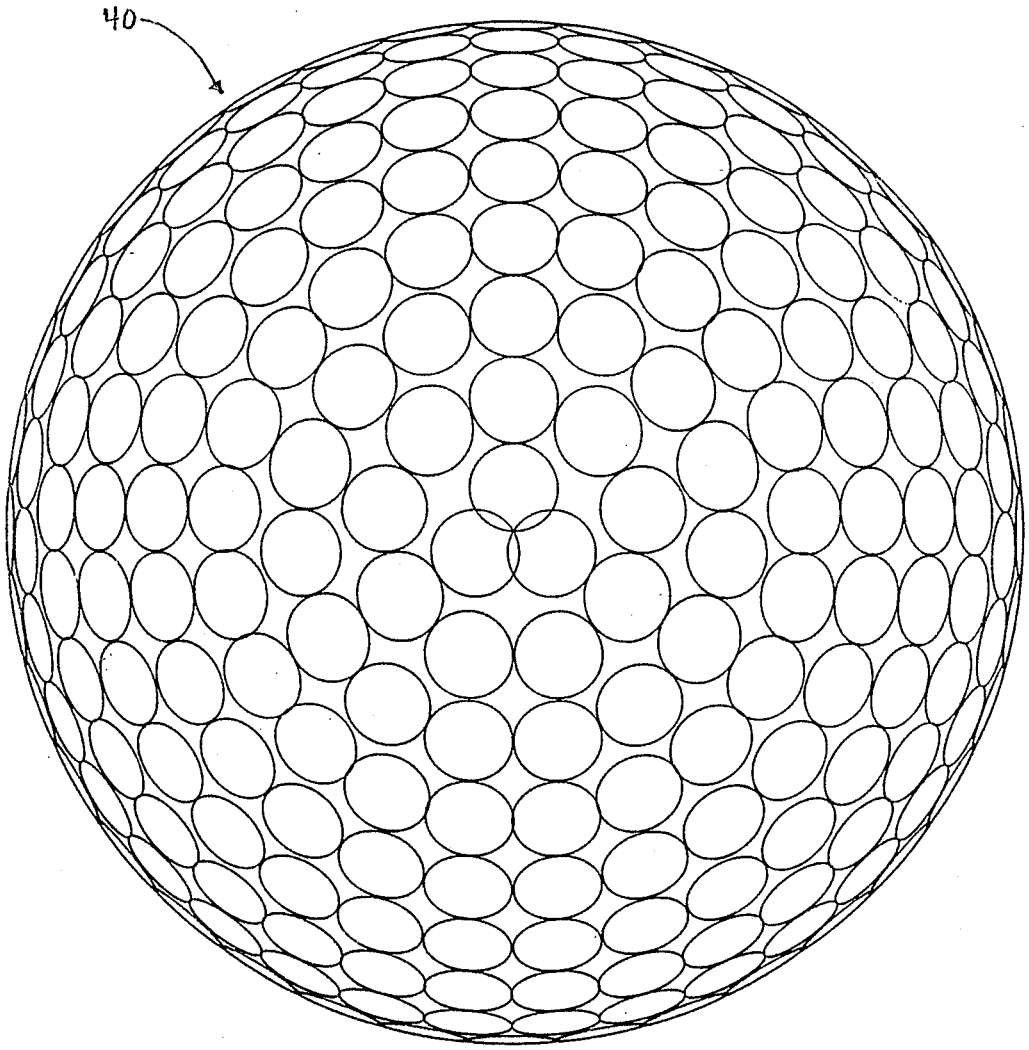
FIG. 4 is a polar view of a 36 code golf ball dimple pattern not fitting within the invention.

On coded golf balls of this invention, each dimple diameter will subtend at the center of the golf ball at a cone angle of 360/n degrees of arc, from which must be subtracted whatever flash allowance is required by the manufacturer to determine true dimple diameter. FIGS. 1, 2, and 3 illustrate 32, 36, and 40 code dimple patterns on all of which the flash allowance is 1.7 degrees of arc. The dimple diameters illustrated on the golf ball 40 of FIG. 4 are the full diameter without flash allowance on a 36 code dimple pattern. The cross eyed appearance of the three dimples in row U illustrates the anomaly associated when feature No. 7 above is not found.

The depths of the dimples found on the golf balls are determined in routine fashion, using known criteria. The preferred method of determining dimple depth, for a given carry and roll, on any golf ball with a coded dimple pattern is to follow the procedures outlined in "The Curious History of the Golf Ball, Mankinds Most Fascinating Sphere", by John Stuart Martin, Horizon Press, New York, pp. 127–130, the disclosure of which is herein incorporated by reference.

The following mathematical analysis is offered to prove the theory on which this invention is based. The formulae together with the examples are presented to substantiate the need for a dimple pattern in accord with the aforelisted features.

Criteria For Dimple Symmetry

LET:

A=Surface area of golf ball, in. squared.

c=Circumference of golf ball, in.

D=Diameter of golf ball, in.

n=Number of dimples on equator.

N=Total dimples on ball.

Prove that, for uniform dimple density on the surface of the golf ball, N must equal $n^2/Pi$.

Proof—For uniform dimple density, $N/n^2$ must be proportional to $A/c^2$.

Substituting for A and c, $$\begin{aligned} N/n^2 &= 4\,\mathrm{Pi}\,r^2/(Pi\,D)^2 \\ &= 4\,Pi\,r^2/4\,Pi^2\,r^2 \\ &= 1/Pi \end{aligned}$$

Multiplying throughout by $n^2$, $$N = n^2/Pi \text{ (dimensionless) Q.E.D.}$$

The first criterion for dimple symmetry is that $N=n^2/Pi$. This establishes how many dimples must be on the ball in order for symmetry to exist. The code number, n, acts as a starting anchor, since it represents the number of dimples on that latitude.

The second criterion for dimple symmetry is that dimple asymmetry$=N-n^2/Pi$. This enables one to make numerical comparisons between one dimple pattern and another (see TABLE 1 for examples).

The third criterion for dimple symmetry is that there must be three dimples in both ultimate rows, U, at the poles. This derives from the fact that when there are three pennies in a group arranged tangent to each other on a flat surface, such as is approximated at the pole of a golf ball, only then can each penny touch all other pennies in the group. This condition assures that there is a minimum surface between the dimples at the pole so that the dimple pattern covers the surface of the ball completely.

The fourth criterion for dimple symmetry is that the latitude of both ultimate rows, U, must always equal 90−(180/n cos 30). This ensures that the three dimples adjacent each pole will not intersect one another.

The fifth criterion for dimple symmetry is that one dimple in each of the three dimple ultimate rows, U, must be spaced 180 longitudinal degrees from a dimple in the penultimate row, P, of nine dimples. This, in combination with the forth criterion, ensures that the dimples in ultimate rows, U, mesh with the penultimate rows of nine dimples, P, without intersecting them.

The examples of these five criteria, as shown in TABLE 1, explode the old assumption that parallel rows of dimples cannot be made to yield symmetrical dimple patterns.

Before examining the six examples of coded dimple patterns according to this invention, TABLE 1 tabulates the dimple asymmetries of eleven golf balls with uncoded dimple patterns. Dimple asymmetries are determined using the equation $(N-n^2/Pi)/N$ and are expressed as a percentage. Dimple asymmetries of the eleven golf balls run from 0.72% to 26%. Note that, since the dimple patterns of all of these examples fail to have three dimples in any of their ultimate rows, U, and that these are not nested in the nine dimples of their penultimate rows, P, they violate dimple symmetry criteria 3, 4, and 5.

It should be noted further that, of all the polyhedral patterns used as a basis for golf ball dimple patterns, neither octahedrons, icosahedrons, nor dodecahedrons have three dimples in the ultimate rows, U, adjacent their poles. This precludes symmetry according to the third criterion.

All six examples of coded dimple pattern according to this invention do have three dimples in their ultimate rows, U, and these do nest in their penultimate rows, P. Thus, all six examples of this invention satisfy criteria 3, 4, and 5. In addition, their dimple asymmetries, ranging from 0.015% to 0.37%, are all less than the uncoded patterns.

TABLE 1

| GOLF BALL | n (1) | N (2) | Dimple Asymmetry (3) |
|---|---|---|---|
| TITLEISTS (4) | 30 | 384 | 26% |
| TOPFLITE PLUS (5) | 35 | 492 | 21% |
| GOLDEN RAM (6) | 35 | 492 | 21% |
| TOPFLITE 11 (5) | 30 | 336 | 15% |
| TOPFLITE XL (5) | 30 | 330 | 13% |
| PINNACLE (4) | 30 | 324 | 12% |
| U.S. Pat. No. 4,765,626, FIGS. 6, 6A | 32 | 368 | 12% |
| U.S. Pat. No. 4,765,626, FIGS. 7, 7A | 42 | 632 | 11% |
| STAFF (7) | 35 | 432 | 10% |
| U.S. Pat. No. 4,720,111, FIG. 2 | 40 | 504 | 0.99% |
| U.S. Pat. No. 4,720,111, FIG. 1 | 36 | 416 | 0.72% |
| THIS INVENTION | 28 | 250 | 0.18% |
| THIS INVENTION | 32 | 326 | 0.015% |
| THIS INVENTION | 36 | 412 | 0.13% |
| THIS INVENTION | 40 | 508 | 0.26% |
| THIS INVENTION | 44 | 614 | 0.37% |

TABLE 1-continued

| GOLF BALL | n (1) | N (2) | Dimple Asymmetry (3) |
|---|---|---|---|
| THIS INVENTION | 48 | 732 | 0.19% |

(1) Dimples on row nearest equator
(2) Total dimples
(3) $(N-n^2/Pi)/N$,%
(4) Available from Acushnet, Inc.
(5) Available from Spalding, Div. of Questor, Inc.
(6) Available from Ramgolf Corp.
(7) Available from Wilson Sporting Goods, Inc.

The range of code numbers shown in Table 1, n=28 to 48, for the golf balls of this invention provides a range of total dimples, N, on the ball of 250 to 732. This is considerably greater than the range occupied by today's commercial golf balls. It may be extended upwards as far as is found desirable and down to n=16 and N=82.

The invention has been described with particularity. It should be understood all obvious variations and modifications of the described golf balls of the invention are within the scope of the appended claims.

What is claimed is:

1. A golf ball having a symmetrical dimple pattern on each hemispherical surface wherein the dimples on both hemispherical surfaces are arranged in rows parallel to an equator of the ball and further wherein there are three dimples in each ultimate row, nine dimples in each penultimate row with the three dimples in the ultimate row nestling in the dimples of the penultimate row, a number of dimples within the range of 16 to 92 dimples in the row nearest the equator of the ball and further said number of dimples is a multiple of four, and the number of rows in each hemisphere is equal to the number of the dimples in the row nearest the equator divided by four.

2. The golf ball of claim 1 wherein the exact latitude and longitude of every dimple in either hemisphere is determined from a number equal to the number of dimples in the row nearest the equator of the ball.

3. The golf ball of claim 2 wherein the number of dimples in the row nearest the ball's equator ranges from 32 to 40.

4. The golf ball of claim 2 further wherein the latitude to the nearest integer of each row other than the ultimate row is equal to $$\frac{(R \times 360) - 180}{n}$$

where R equals the number of the row counting from the equator and n equals the number of dimples in each row nearest the ball's equator.

5. The golf ball of claim 4 wherein the number of dimples in each row other than the ultimate row, to the nearest integer, equals n× the cosine of the latitude, the first dimple in each row is located on the zero meridian and one of the three dimples in the ultimate row is located on longitude 180 and at latitude (90−180/n cos 30).

* * * * *